United States Patent [19]

Frenkel

[11] 4,400,921

[45] Aug. 30, 1983

[54] BUILDING STRUCTURE AND THE METHOD OF ERECTING BUILDINGS FROM RIBBED AND CHANNELLED SHEETS

[76] Inventor: Benjamin Frenkel, 27 Sheshet Hayamim St., Herzlia, Israel

[21] Appl. No.: 178,906

[22] Filed: Aug. 18, 1980

[30] Foreign Application Priority Data

Sep. 10, 1979 [IL] Israel ..... 58216

[51] Int. Cl.[3] ..... E04C 1/38

[52] U.S. Cl. ..... 52/284; 52/748; 52/814

[58] Field of Search ..... 52/476, 272, 276, 277, 52/278, 284, 813, 823, 537, 630, 748, 745, 242, 588; 256/24, 21, 25, 73; 405/284, 276, 274

[56] References Cited

U.S. PATENT DOCUMENTS

| | | | |
|---|---|---|---|
| 2,824,341 | 2/1958 | Ashton | 52/814 |
| 3,568,388 | 3/1971 | Flachbarth | 52/630 |
| 3,798,853 | 3/1974 | Castle | 52/57 |

*Primary Examiner*—John E. Murtagh

[57] ABSTRACT

Buildings, such as huts or storerooms are erected from ribbed and channelled metal or plastics sheets. The sheets are held in top and bottom channel profiles, the end portions of the top channels have part of their side walls cut away.

3 Claims, 8 Drawing Figures

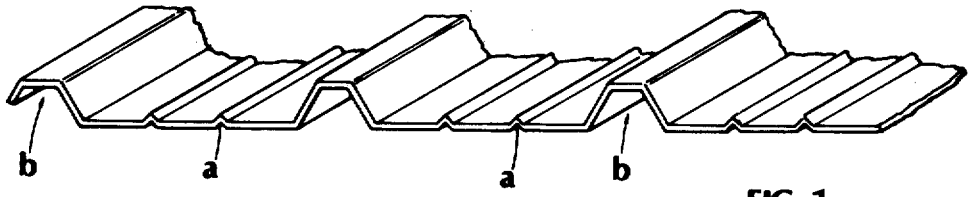
FIG. 1
FIG. 2
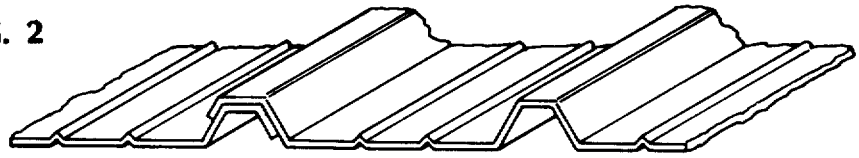
FIG. 3
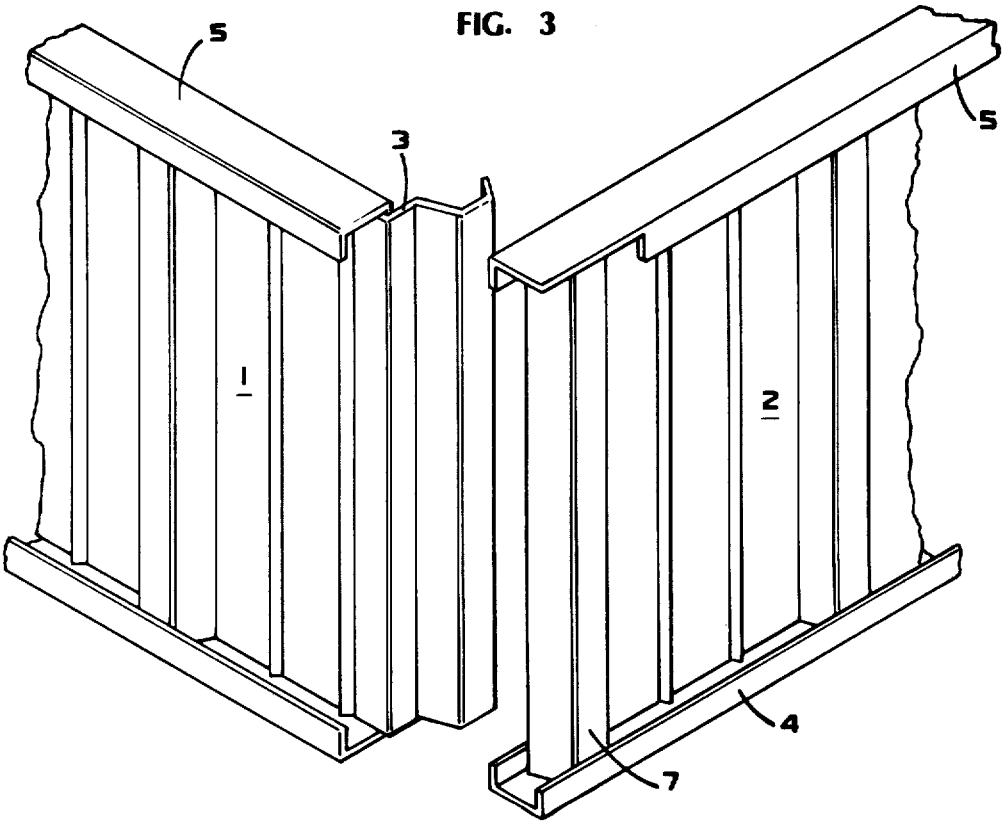

FIG. 4
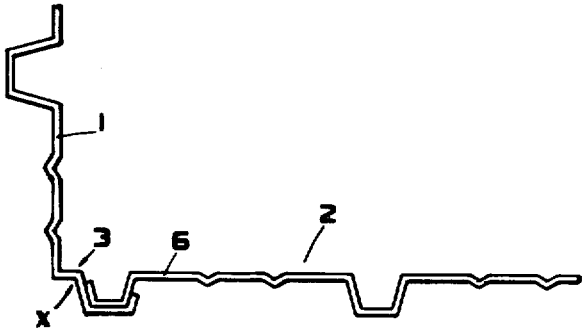
FIG. 5
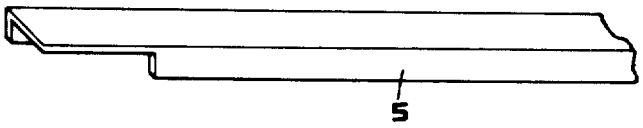
FIG. 6
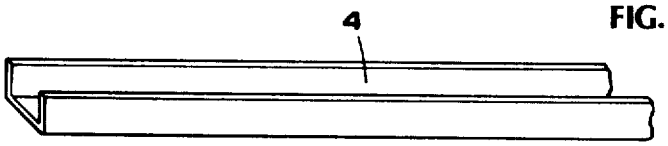
FIG. 7
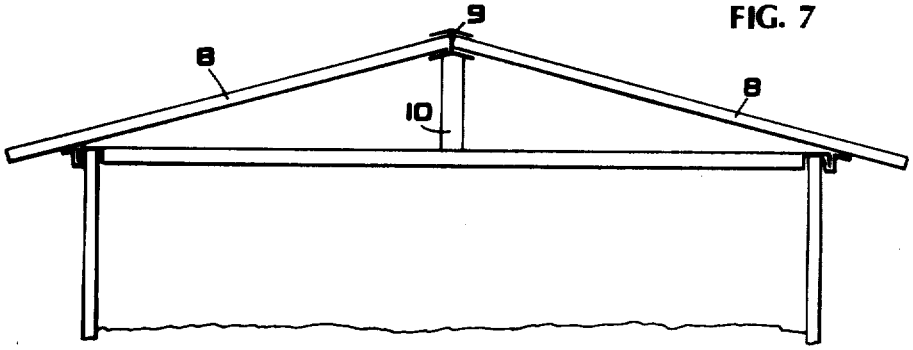
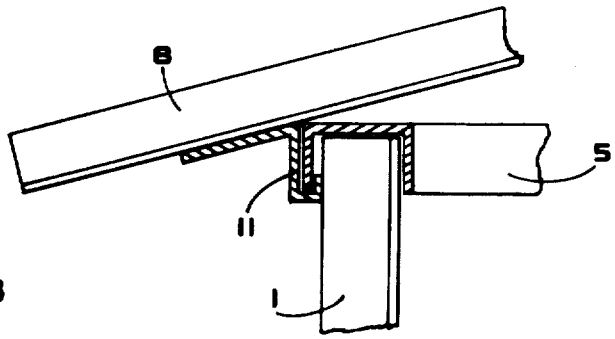
FIG. 8

BUILDING STRUCTURE AND THE METHOD OF ERECTING BUILDINGS FROM RIBBED AND CHANNELLED SHEETS

FIELD AND BACKGROUND OF INVENTION

The present invention relates to a method of erecting buildings from commercially available metal sheets, as shown in FIG. 1 of the annexed drawing.

These sheets are available in standard width and are stiffened by ribs a which are obtained by pressing operations in a known manner. The sheets have also pressed out channels which—while also contributing to stiffening of the sheet—serve also for connecting juxtaposed sheets, as is required in the formation of a wall from several sheets. These channels are indicated by the letter b in FIG. 1, and as can be seen in FIG. 2, the connection of two juxtaposed sheets is brought about by placing the two sheets overlappingly one beside the other with a channel b of one sheet lying within the channel b of the vicinal sheet (as indicated by X in FIG. 2).

It is common practice to provide U-rails or channel sections at the top and bottom of an assembled wall, the upper and the bottom edge thereof being inserted in the said channel sections. Usually the unassembled ribbed sheets, the channel sections and auxiliary elements are transported to the site where the respective building is to be erected and the assembling of individual elements, their connection with one another, the construction of a roof and other incidental operations are performed at the site.

I have now devised a method permitting the greater part of the work being performed in a workshop and transporting to the site ready assembled walls and roofs, so that at the building site the ready walls have just to be erected—either on the ground or a previously cast or otherwise prepared base—and connected with one another. In order to be able to do this some novel steps have to be taken and the constitutive elements have to be appropriately shaped and prepared.

OBJECT OF THE INVENTION

It is therefore the object of this invention to prepare the constitutive parts of a modular building of the kind referred to above in such a manner that the assemblage of these parts can be performed in a workshop while at the building site only the final placing of the walls and connection to one another and the putting in place of the roof is performed.

SHORT SUMMARY OF THE INVENTION

In performing my new method, I prepare the walls of the building by laying the standard widths of the commercially available ribbed panels beside one another in a manner that vicinal panels overlap at their vicinal edges and the outermost channel of one panel comes to lie within (or on) the outermost channel of another panel; I then introduce the so assembled wall into a bottom channel, connect all vicinal panels, prepare the top channel by partly cutting away the end portion of one of the side walls of the channel (for a purpose to be referred to later), the so prepared assembly may now be carried as a unit to the site and several such units, each forming a wall can be interconnected to form the final building which is then topped by a roof.

SHORT DESCRIPTION OF DRAWINGS

The invention will now be described in detail, referring to the annexed drawings.

In the drawings, FIG. 1 is a perspective fractional view of a commercially available, ribbed panel.

FIG. 2 is a perspective, fractional view of a connection of two juxtaposed sheets.

FIG. 3 is a perspective view of wall assemblies—prior to being interconnected—at the corner of a building.

FIG. 4 is a schematical, horizontal section of a corner of a building erected according to the method of this invention.

FIGS. 5 and 6 are perspective, fractional views of channel elements to be used in the method.

FIG. 7 illustrates the construction of a roof according to the new method, while FIG. 8 shows a detail (on an enlarged scale).

DESCRIPTION OF PREFERRED EMBODIMENT

As already stated above, the constituents of a wall unit are assembled in a workshop and are transported to the building site in a condition which permits the connection of walls to one another at the site. The individual panels are slid into the bottom and the top channel respectively, so that the vertical edges of two vicinal panels overlap and the channel b of one panel comes to lie within the similar channel b of the other panel. Now these two panels can be united by connecting them by whatever known means, such as spotwelding or rivetting. Where two assembled wall units indicated in FIGS. 3 and 4 by the numerals 1 and 2 are to be connected with one another to form the corner of a building, the marginal portion of one of the channels is bent off at right angles as shown at 3 in FIG. 4. As can be seen in FIG. 3 the individual panels are held in a bottom rail or channel 4 and a top rail or channel 5. The assembled units 1 and 2 arrive in that state at the building site. It will be realised—as can be seen in FIG. 3—that the bent off marginal portion 3 has to engage the marginal (unbent) portion of wall unit 2. That would have been impossible had not the side wall of channel 5 been cut in an appropriate way, as can be seen in FIG. 5. This step in the preparation of the constituents of the wall assemblies makes it possible to perform the assemblage in the shop and attend to the final connection of the units at the site.

Turning now to FIG. 7 showing the roof construction, this is composed of roofing panels 8 extending in an ascending plane and resting with their lower edge on a top channel 5, while the upper edge is engaged by a rail of substantially H-profile 9 which is supported by a king post 10. The rail 9 is placed with its web in the vertical while the two flanges are bent to an inclination to suit the inclination of the roofing panels 8. Thus the upper ends of these latter can simply be shifted into the confines of the rail 9, abutting against the web of the H. In a similar manner an inclined flange 11 is attached to and extends from the top channel 5 (see FIG. 8), so that the lower end of a panel 8 may rest thereon.

What is claimed is:

1. A building comprising:

a plurality of wall elements, each wall element including at least one sheet having defined thereon a plurality of vertically extending channel shaped ribs extending from a top edge of the sheet to a bottom edge thereof and top and bottom channel members engaging said top and bottom edges to define a generally planar main wall portion;

said at least one sheet being bent along a vertical line intermediate said vertically extending channel ribs to define a joining portion including a vertically extending channel shaped rib, said joining portion extending beyond said top and bottom channel members and being angled with respect to said main wall portion;

said plurality of wall elements being joined to each other to define an enclosure wherein the joining portion of each wall element is arranged in overlapping parallel engagement with a portion of said at least one sheet forming part of the main wall portion of an adjacent wall element, and wherein at least one of said top and bottom channel members is provided with a cut out portion adjacent a side edge thereof for accommodating the joining portion of an adjacent wall element, whereby the vertically extending channel shaped rib of said joining portion lies in coplanar parallel registration with a vertically extending channel shaped rib of the main wall portion of an adjacent wall element.

2. A building according to claim 1 and wherein said joining portion is arranged to lie in a plane separated from the plane of said main wall portion by 90°.

3. A method for constructing a building comprising the steps of:

providing a plurality of sheets, each having defined thereon a plurality of vertically extending channel shaped ribs extending from a top edge of each sheet to a bottom edge thereof;

providing a plurality of top and bottom channel members;

arranging top and bottom channel members along the respective top and bottom edges of a plurality of said sheets to define a plurality of wall elements, each comprising at least one sheet;

bending at least one sheet of each of said plurality of wall elements along a vertical line intermediate said vertically extending channel shaped ribs to define a main wall portion coplanar with said top and bottom channel members and a joining portion disposed in a plane angled with respect thereto, said joining portion extending beyond said top and bottom channel members;

joining the joining portion of each of said plurality of wall elements to the main wall portion of another of said plurality of wall elements in overlapping parallel engagement, and cutting out a portion of at least one of said top and bottom channel members adjacent an edge thereof for accommodating the joining portion of an adjacent wall element, whereby the vertically extending channel shaped rib of the joining portion lies in parallel registration with a vertically extending channel shaped rib of said main wall portion.

* * * * *